US010299558B2

(12) United States Patent
Yifrach et al.

(10) Patent No.: US 10,299,558 B2
(45) Date of Patent: May 28, 2019

(54) HOT AIR BLOWER AND BLOWING METHOD

(71) Applicant: DAVID & D LTD., Ganei Tikva (IL)

(72) Inventors: David Yifrach, Ganei Tikva (IL); Harel Shalom, Beer Sheva (IL)

(73) Assignee: DAVID & D LTD., Ganei Tikva (IL)

( * ) Notice: Subject to any disclaimer, the term of this patent is extended or adjusted under 35 U.S.C. 154(b) by 310 days.

(21) Appl. No.: 15/268,588

(22) Filed: Sep. 18, 2016

(65) Prior Publication Data

US 2017/0095049 A1 Apr. 6, 2017

Related U.S. Application Data

(60) Provisional application No. 62/235,588, filed on Oct. 1, 2015.

(51) Int. Cl.
*A45D 20/06* (2006.01)

(52) U.S. Cl.
CPC ..... *A45D 20/06* (2013.01); *A45D 2020/065* (2013.01)

(58) Field of Classification Search
CPC ..... A45D 20/06; A45D 2020/065
USPC ..... 34/493, 97
See application file for complete search history.

(56) References Cited

U.S. PATENT DOCUMENTS 4,555,232 A * 11/1985 Raccah ..... A45D 20/06 126/401
4,635,382 A * 1/1987 Bourdeau ..... A45D 20/06 126/401
4,800,654 A * 1/1989 Levin ..... A45D 1/02 126/401
4,903,416 A * 2/1990 Levin ..... A45D 1/02 126/401
4,924,849 A * 5/1990 Zaborowski ..... A45D 1/02 126/408
5,009,592 A * 4/1991 Roldan ..... A45D 20/06 432/222
5,155,925 A * 10/1992 Choi ..... A45D 20/06 34/97
5,608,975 A * 3/1997 Hsu ..... A45D 20/06 34/96
6,058,944 A 5/2000 Katherine
6,983,550 B1 * 1/2006 Lin ..... F23D 14/18 34/96

(Continued)

FOREIGN PATENT DOCUMENTS

EP 1366687 A4 * 9/2008 ..... A45D 20/06
JP 2005087445 4/2005

(Continued)

*Primary Examiner* — Stephen M Gravini
(74) *Attorney, Agent, or Firm* — Alphapatent Associates, Ltd; Daniel J. Swirsky

(57) ABSTRACT

A hot air blower, including: an air channel for blowing a main stream of air therethrough by an electric fan; a gas tank, for supplying burning gas; a gas burner, including: an air inlet, disposed within the air channel, for receiving a first portion of the main air stream; a burning gas inlet for receiving the burning gas; and an outlet, disposed within the air channel, thereby the gas burner produces a flame at the outlet within the air channel, for heating the main air stream; and a mechanism, for automatically fitting a size of the air inlet to an extent of the main air stream and consequently to an extent of the second portion thereof.

6 Claims, 7 Drawing Sheets

(56) References Cited

U.S. PATENT DOCUMENTS

| | | | | |
|---|---|---|---|---|
| 7,065,899 | B2 * | 6/2006 | Lin | F24H 3/0488 34/97 |
| 7,260,900 | B2 * | 8/2007 | Anthes | A45D 1/02 34/97 |
| 7,356,942 | B2 * | 4/2008 | Lin | F23D 14/18 34/96 |
| 7,913,416 | B1 * | 3/2011 | Scieri | A45D 20/10 34/96 |
| 8,727,389 | B2 * | 5/2014 | Burdsall | F16L 37/2445 220/254.8 |
| 9,182,144 | B2 * | 11/2015 | Chen | F24H 3/02 |
| 9,596,916 | B2 * | 3/2017 | Moloney | A45D 20/10 |
| 9,808,066 | B2 * | 11/2017 | Moloney | A45D 20/10 |
| 9,883,726 | B2 * | 2/2018 | Hsu | A45D 20/12 |
| 10,021,952 | B2 * | 7/2018 | Goldman | A45D 20/12 |
| 10,085,538 | B2 * | 10/2018 | Saunders | A45D 20/12 |
| 2004/0078992 | A1 | 4/2004 | Fujiwara | |
| 2004/0216322 | A1 * | 11/2004 | Collier | A45D 20/06 34/97 |
| 2006/0018637 | A1 * | 1/2006 | Lin | A45D 20/06 392/384 |
| 2006/0183067 | A1 * | 8/2006 | Kokuo | F23D 14/70 431/350 |
| 2006/0194160 | A1 * | 8/2006 | Kokuo | A45D 20/06 431/12 |
| 2006/0236557 | A1 * | 10/2006 | Bousfield | A45D 20/06 34/96 |
| 2017/0095049 | A1 * | 4/2017 | Yifrach | A45D 20/06 |

FOREIGN PATENT DOCUMENTS

| | | | | |
|---|---|---|---|---|
| JP | 4050001 | B2 * | 2/2008 | A45D 20/06 |
| WO | WO-02063990 | A1 * | 8/2002 | A45D 20/06 |

* cited by examiner

HOT AIR BLOWER AND BLOWING METHOD

CROSS-REFERENCE TO RELATED APPLICATIONS

This application claims the benefit of priority from U.S. Provisional Application No. 62/235,588, filed Oct. 1, 2015, the disclosure of which is incorporated herein by reference.

TECHNICAL FIELD

The invention relates to the field of hair dryers and hot air blowers. More particularly, the invention relates to a cordless apparatus for blowing hot air.

BACKGROUND

The main power required for a hot air blower is for the electric heating element. Since the heating element consumes high power, thus, conventionally hot air blowers are not durable with batteries.

Heating by a flame, for obtaining a cordless hot air blower, produces problems that the air flow extinguishes the flame.

The invention provides a solution to the above-mentioned and other problems of the prior art.

SUMMARY

In one aspect, the invention is directed to a hot air blower, including:

an air channel for blowing a main stream of air therethrough by an electric fan;

a gas tank, for supplying burning gas;

a gas burner, including:

a) an air inlet, disposed within the air channel, for receiving a first portion of the main air stream;

b) a burning gas inlet for receiving the burning gas; and c) an outlet, disposed within the air channel, thereby the gas burner produces a flame at the outlet within the air channel, for heating the main air stream, wherein the flame is fed by the first air portion, by the burning gas, and by a second portion of the main stream not entering the gas burner; and a mechanism, for automatically fitting a size of the air inlet to an extent of the main air stream and consequently to an extent of the second portion thereof, thereby maintaining the flame durable to changes of the main stream without requiring changing supply rate of the burning gas.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features, methods, systems, procedures, components, circuits, and so on, are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
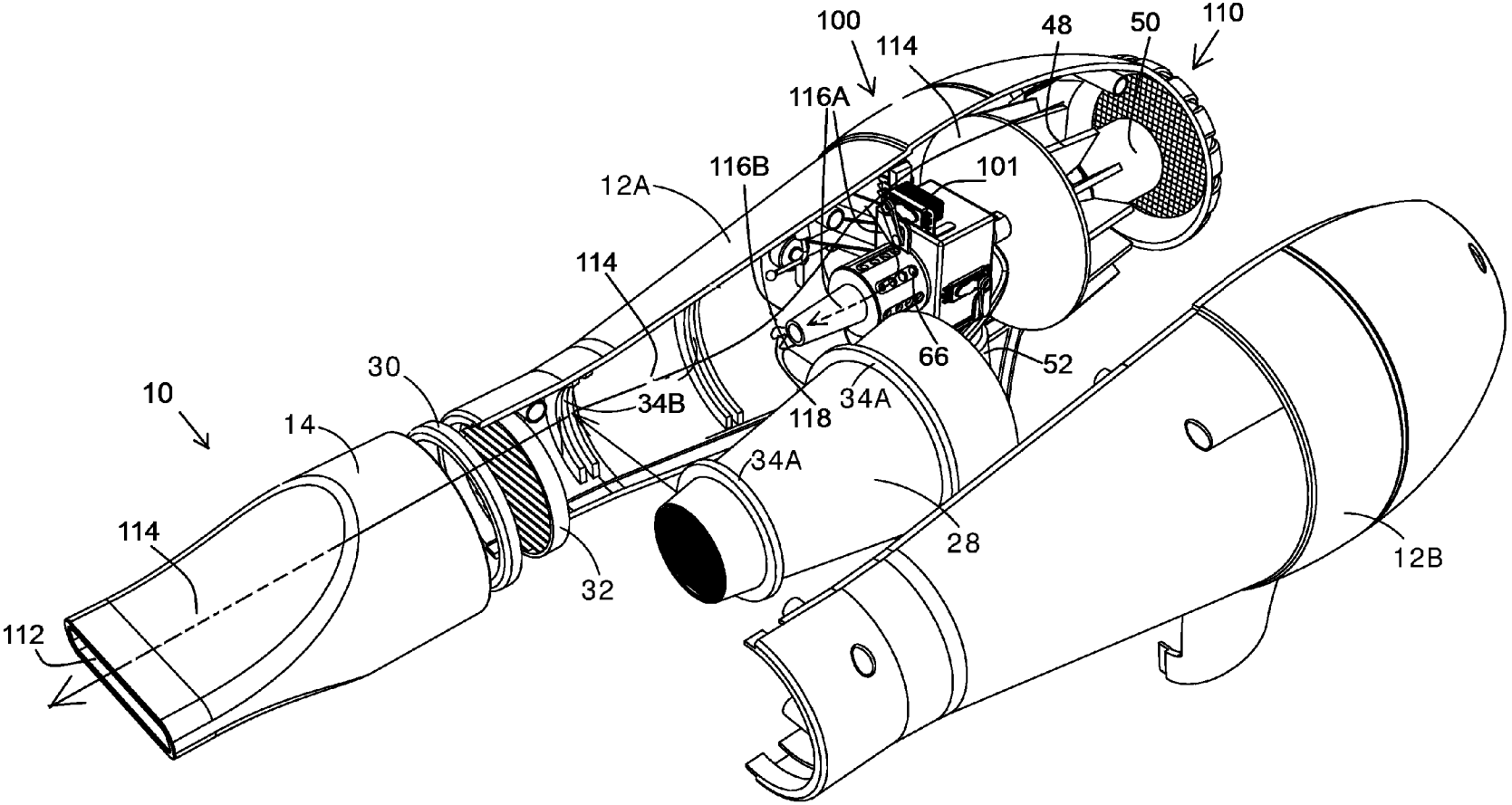
FIG. 1 depicts a disassembled portable air dryer, according to one embodiment of the invention.

FIG. 1 depicts a disassembled portable air dryer, according to one embodiment of the invention.

A hot air blower 10 includes a fan 48 driven by an electric motor 50, for producing a main stream of air 114, starting from an air inlet 110 and ending at an air outlet 112 through an air channel including package members 12A and 12B.

Hot air blower 10 may be cordless, since the significant energy, being of the heating, is provided by a gas tank 52, containing preferably LPG (Liquid Petroleum Gas (propane)).

Burning gas from gas tank 52 and a portion 116A of main air stream 114, enter a gas burner 100, mix, for feeding a flame 118 at the outlet of gas burner 100.

However, flame 118 is also fed by a portion 116B of main air stream 114, which flows outside gas burner 100.

Main air stream 114 is heated by flame 118, and thus the air at outlet 112 is hot. The air flows from flame 118 on through a metal channel 28 for protecting plastic package members 12A and 12B from the heat.

In order that portion 116B, feeds flame 118 and not does not extinguish it, a servo motor 101 controls the amount of air portion 116A entering gas burner 100, such that air portion 116B meeting flame 118, plus air portion 116A provide the best flame. A good flame, being hot and consuming less gas is blue, whereas a bad flame is red.

The greater main air stream 114 is, the smaller air portion 116A must be, for obtaining the best flame 118. Servo motor 101 controls the amount of air portion 116A entering gas burner 100, by closing and opening air inlets 66 of gas burner 100.

Figure 2:
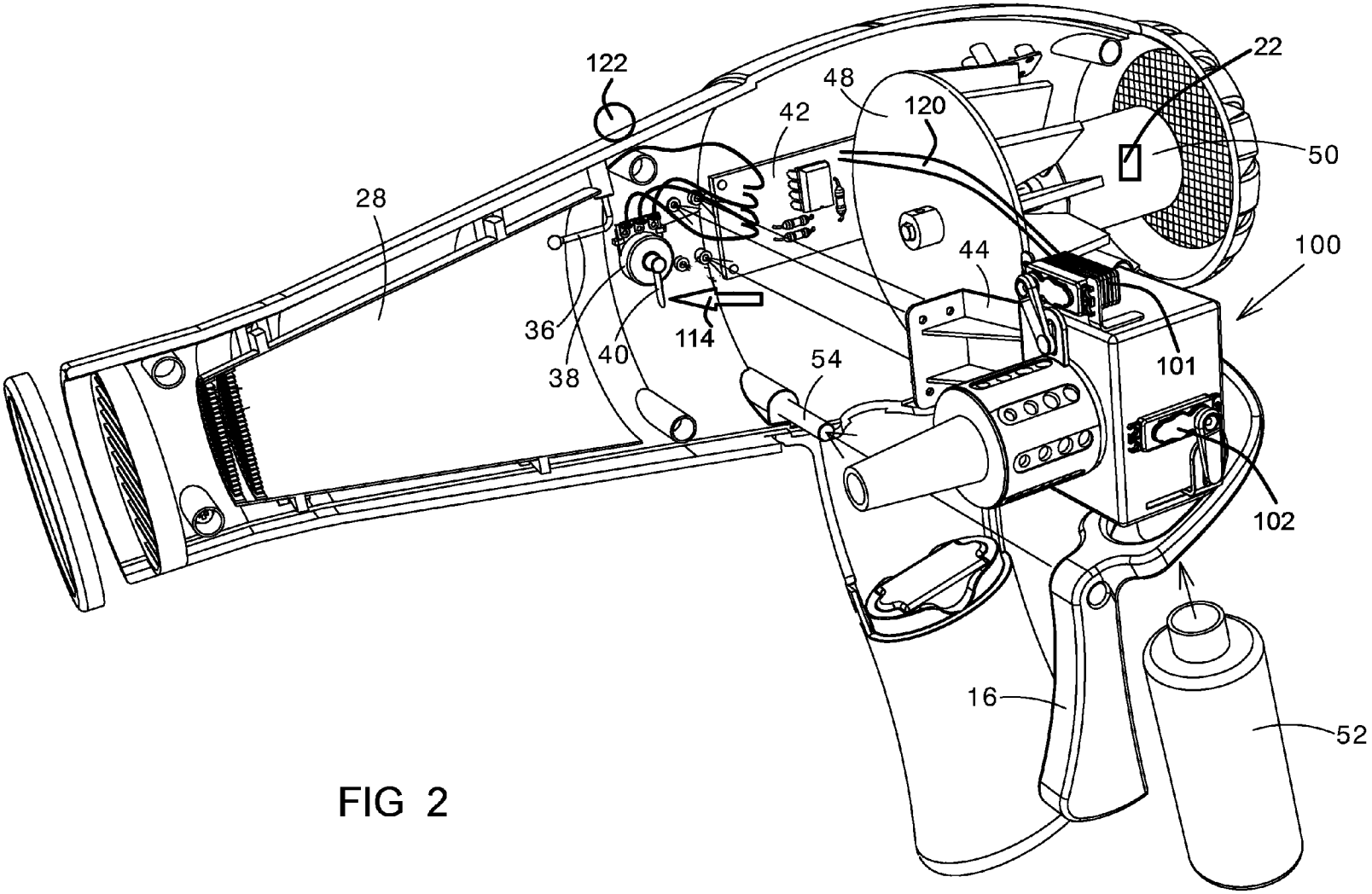
FIG. 2 depicts a disassembled portable air dryer, from another view.

FIG. 2 depicts a disassembled portable air dryer, from another view.

A blade 40 is pressed by main air stream 114, and moves as a function of the extent of main air stream 114 against a spring (not shown). Thus blade 40, as being fixed to a potentiometer 38, functions as an air flow meter, connected to a control circuit 42, which controls servo motor 101, through wires 120.

Figure 3:
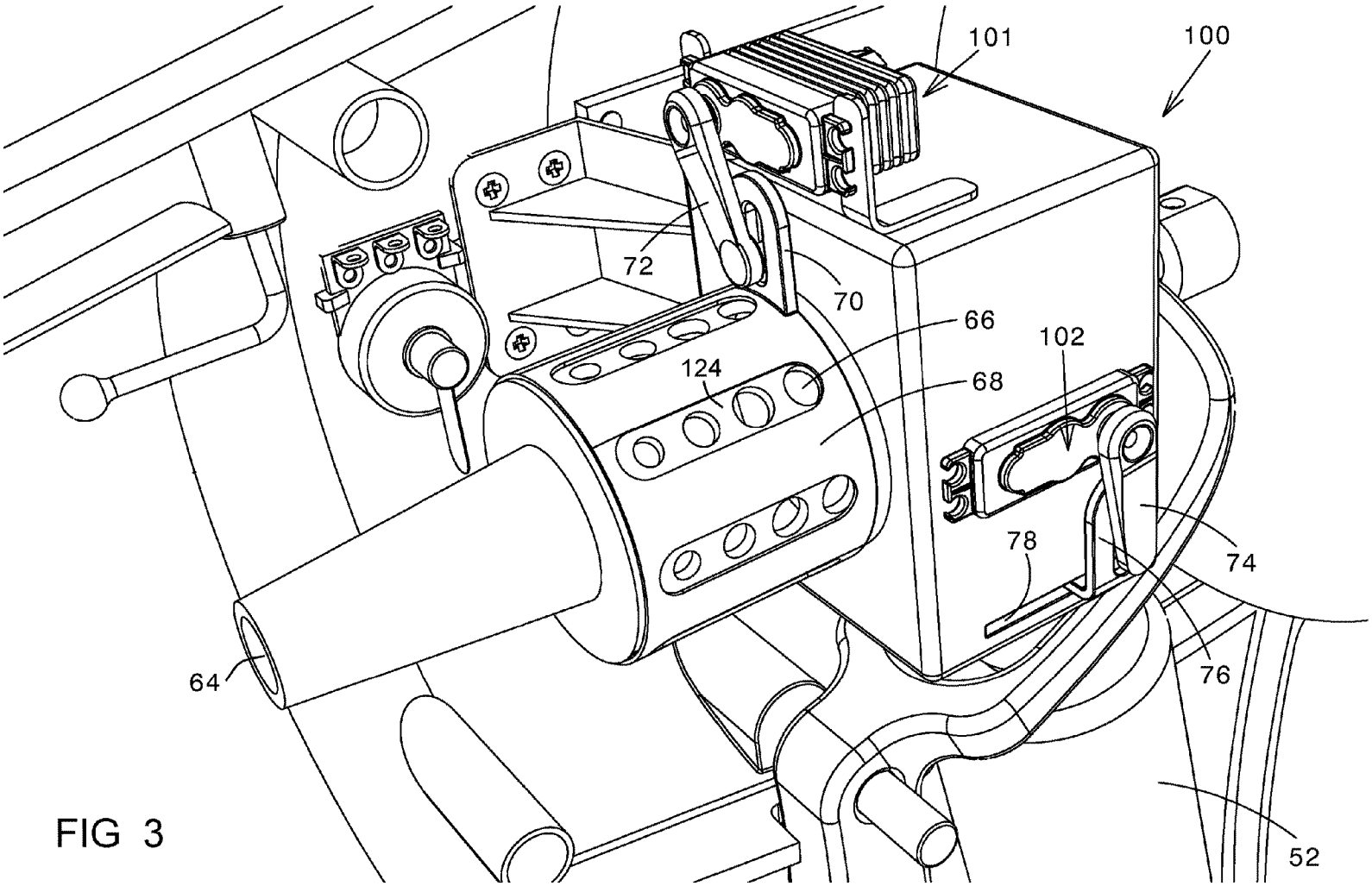
FIG. 3 focuses on the burner of FIG. 1, while the holes are open.

FIG. 3 focuses on the burner of FIG. 1, while the holes are open.

Figure 4:
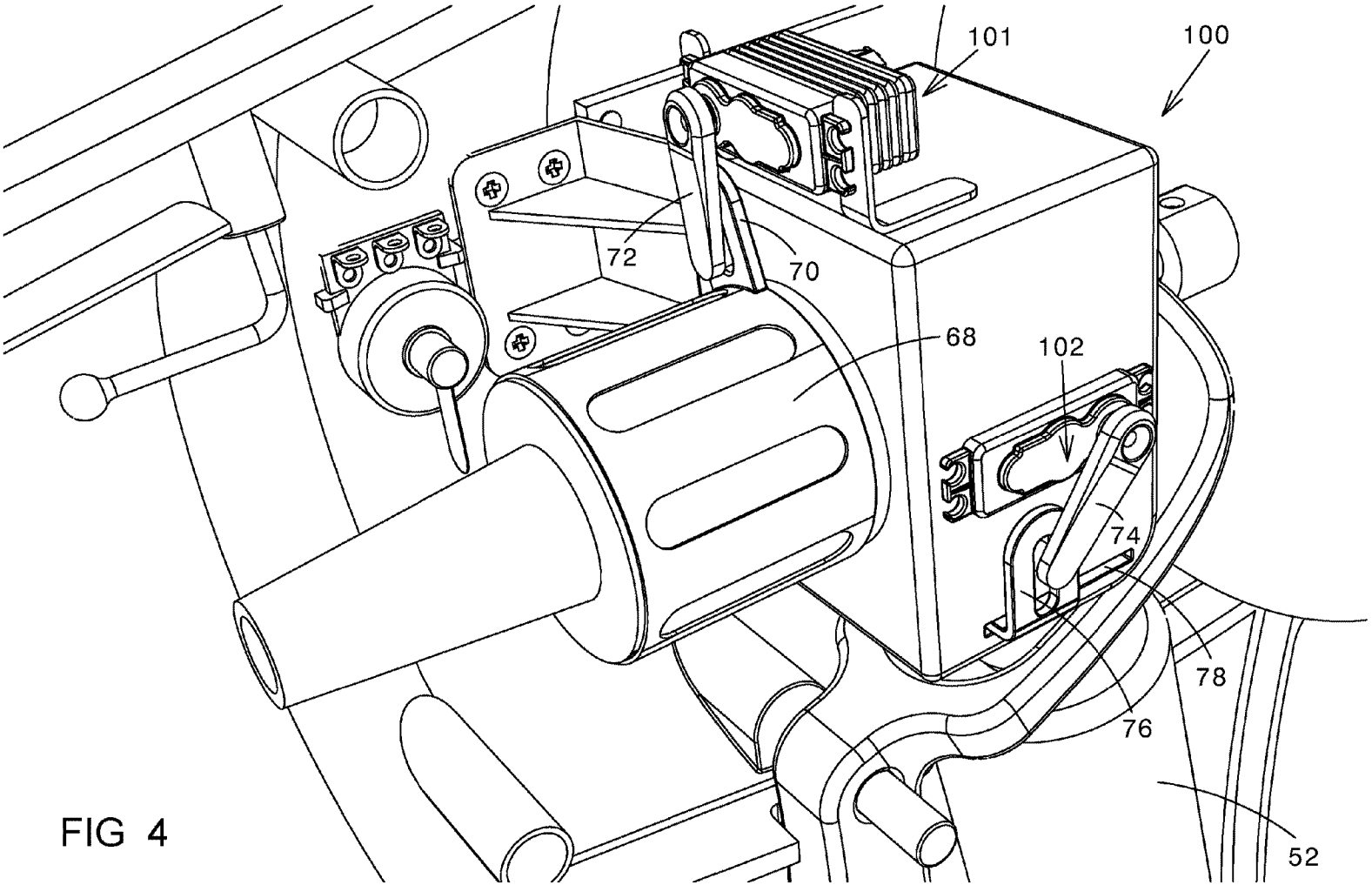
FIG. 4 focuses on the burner of FIG. 1, while the holes are closed.

FIG. 4 focuses on the burner of FIG. 1, while the holes are closed.

A drum 68 including holes 124, is rotatable by a crank 72, moved by servo motor 101, for partially covering air inlets 66.

The user may thus increase the rate of main air stream 114 for receiving increased heat power, while maintaining flame 118.

Referring again to FIG. 2, the user may determine the received heat power by tuning a thermostat 122, controlling a temperature sensor 36.

In case the user demands high heat power by determining the state of thermostat 122, control circuit 42 may select, to a speed selector 22, a higher power state for electric motor 50, for providing a higher main air stream 114. Once temperature sensor 36 senses that the temperature is sufficient, control circuit 42 may decrease the power supplied to electric motor 50 for decreasing main air stream 114.

During the change of main air stream 114, as measured by air flow meter 40, servo motor 101 adjusts the size of air inlets 66, for providing the best flame, for fitting to any level of main air stream 114.

In case that main air stream 114 is too low for the present gas flow, control circuit 42 may decrease the gas flow, through a servo motor 102.

Figure 5:
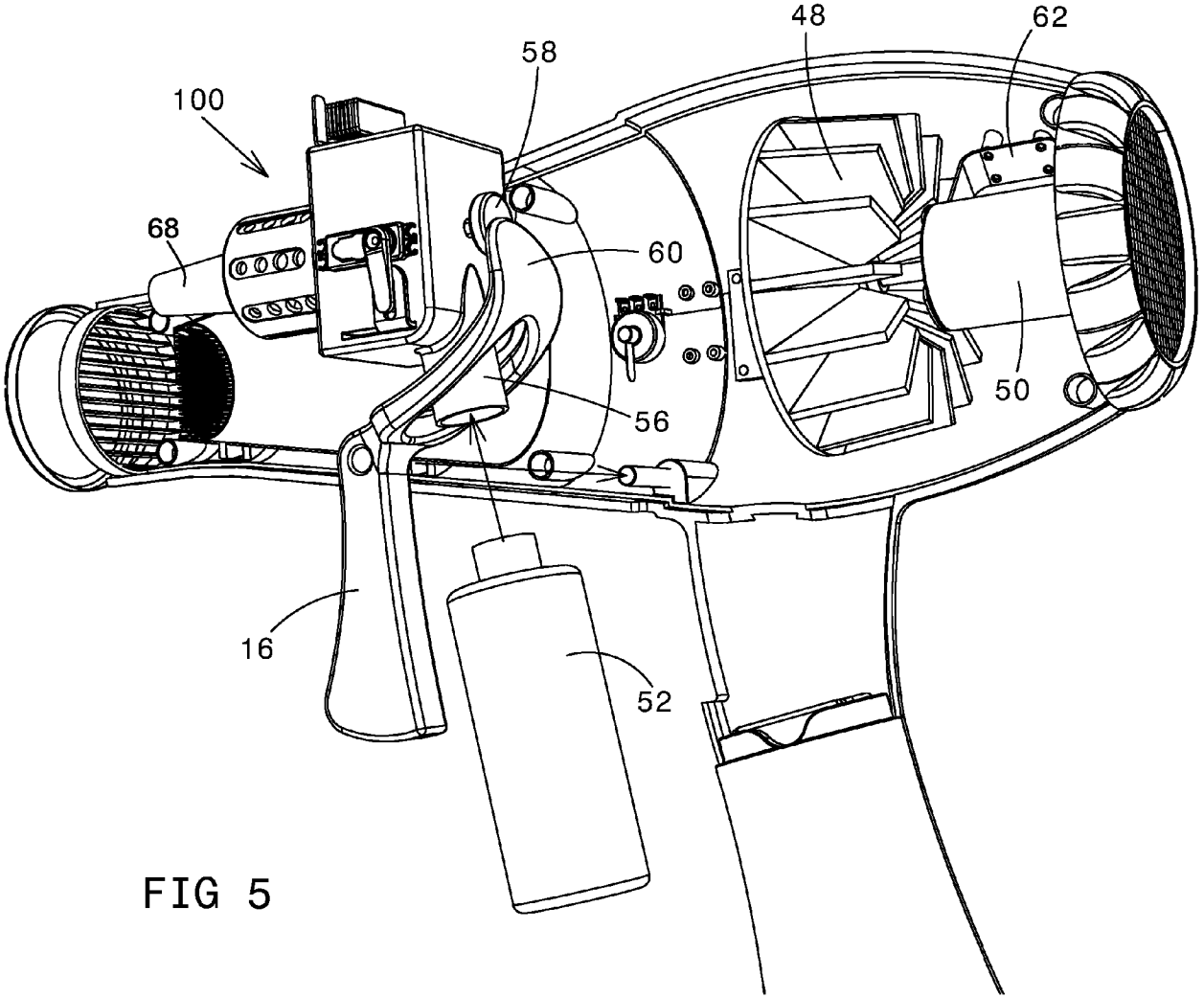
FIG. 5 is a rear view of the burner of FIG. 1.

FIG. 5 is a rear view of the burner of FIG. 1.

A button 58, pressed by a lever 16, may operate a spark producer, for initially lighting flame 118.

Figure 6:
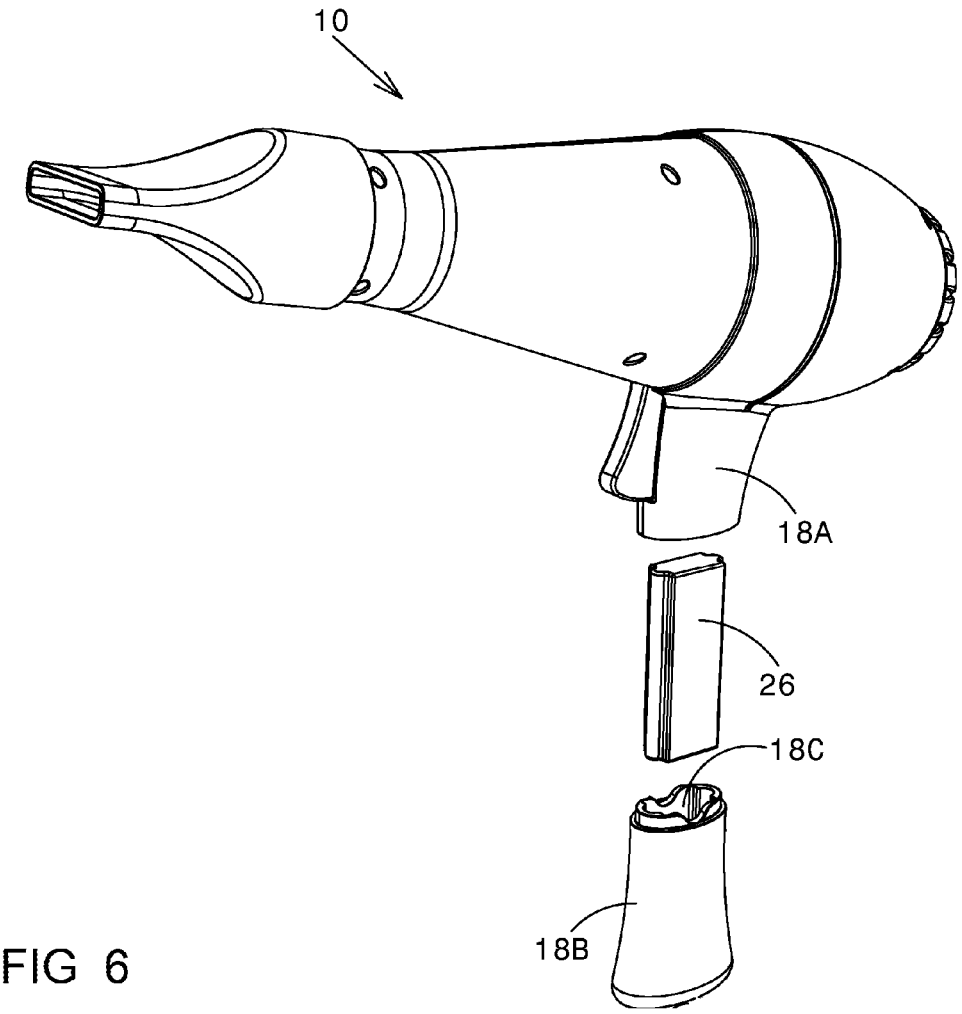
FIG. 6 describes the electric powering of the cordless air dryer of FIG. 1.

FIG. 6 describes the electric powering of the cordless air dryer of FIG. 1.

A battery 26 supplies the electric power required for the electric elements.

Figure 7:
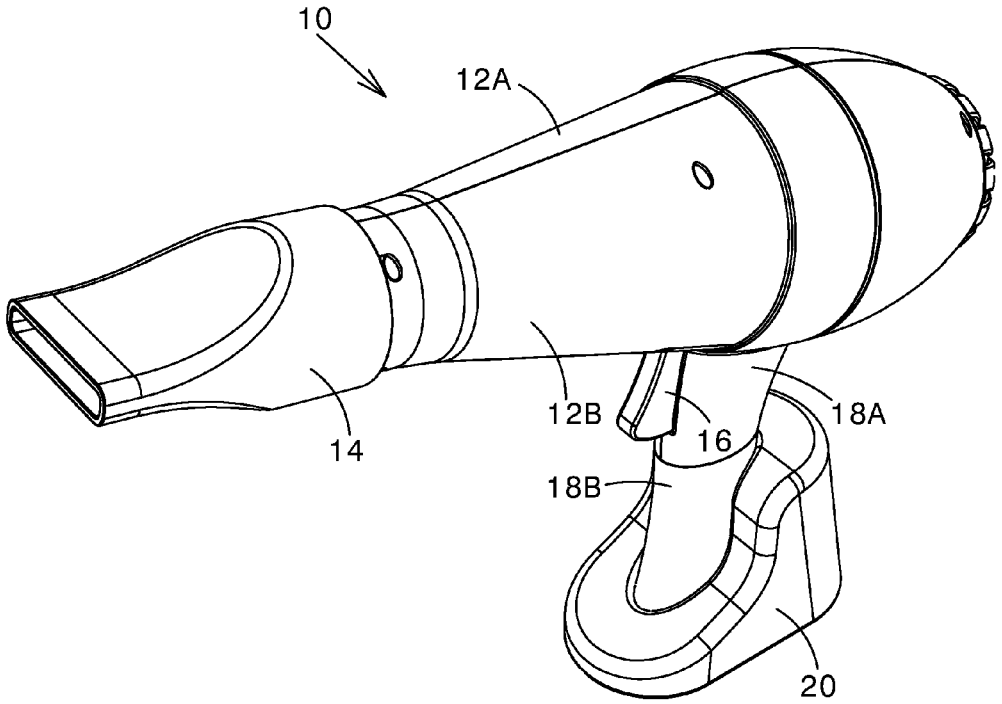
FIG. 7 depicts cordless air dryer of FIG. 1 assembled and standing on an electric charger.

FIG. 7 depicts cordless air dryer of FIG. 1 assembled and standing on an electric charger.

An electric charger 20 may recharge battery 26.

Thus, in one aspect, the invention is directed to a hot air blower (10), including:

an air channel (12A, 12B) for blowing a main stream (114) of air therethrough by an electric fan (48);

a gas tank (52), for supplying burning gas;

a gas burner (100), including:

a) an air inlet (66), disposed within the air channel (12A, 12B), for receiving a first portion (116A) of the main air stream (114);

b) a burning gas inlet (56) for receiving the burning gas; and c) an outlet (64), disposed within the air channel (12A, 12B), thereby the gas burner (100) produces a flame (118) at the outlet (64) within the air channel (12A, 12B), for heating the main air stream (114), wherein the flame (118) is fed by the first air portion (116A), by the burning gas, and by a second portion (116B) of the main stream (114) not entering the gas burner (100); and a mechanism (68, 101), for automatically fitting a size of the air inlet (66) to an extent of the main air stream (114) and consequently to an extent of the second portion (116B) thereof, thereby maintaining the flame durable to changes of the main stream (114) without requiring changing supply rate of the burning gas.

The mechanism (68, 101) for automatically fitting the size of the air inlet (68) to the extent of the main air stream (114) may include a hole (124) for changing congruency thereof with the air inlet (66).

The mechanism (68, 101) for automatically fitting the size of the air inlet (66) to the extent of the main air stream (114) may include:

an air flow meter (40), for measuring the extent of the main air stream (114).

The mechanism (68, 101), for automatically fitting the size of the air inlet (66) to the extent of the main air stream (114) may include:

a servo motor (101), for decreasing and increasing size of the air inlet (66); and a control circuit (42), for controlling the servo motor (101).

The hot air blower (10) may further include:

a speed selector (22), for selecting speed for the fan (48), thereby allowing changing heat supply level of the hot air blower (10).

The hot air blower (10) may further include:

a thermostat (122), for selecting heat supply level of the hot air blower (10).

In another aspect, the invention is directed to a method for blowing hot air, the method including the steps of:

blowing a main stream (114) of air through an air channel (12A, 12B), by an electric fan (48);

producing, by a gas burner (100), a flame (118) within the air channel (12A, 12B), for heating the main air stream (114), the flame (118) being fed by a first air portion (116A) and a burning gas entering the gas burner (100), and by a second portion (116B) of the main stream (114) not entering the gas burner (100); and automatically fitting an extent of the first air portion (116A) to an extent of the main air stream (114) and consequently to an extent of the second portion (116B) thereof, thereby maintaining the flame durable to changes of the main stream (114) without requiring changing supply rate of the burning gas.

The method may further include the step of:

changing extent of the main air stream (114), thereby changing heat supply level of the hot air blower (10).

The method may further include the step of:

selecting a heat supply level of the hot air blower (10);

measuring temperature of the main air stream (114); and selecting an extent of the main air stream (114), for conforming to the selected heat supply level of the hot air blower (10).

In the figures and/or description herein, the following reference numerals (Reference Signs List) have been mentioned:

numeral 10 denotes the cordless hot air blower, according to one embodiment of the invention;

numerals 12A and 12B denote package members, forming an air channel;

numeral 16 denotes a lever;

numerals 18A and 18B denote two members of the handle, containing together the battery;

numeral 20 denotes an electric charger;

numeral 22 denotes a power selector, for the electric motor;

numeral 26 denotes a battery;

numeral 28 denotes a metal channel;

numeral 30 denotes a ring, for attaching package members 12A and 12BB one to the other;

numeral 32 denotes a sieve;

numeral 34A denotes a male track;

numeral 34B denotes a female track;

numeral 36 denotes a temperature sensor;

numeral 38 denotes a potentiometer;

numeral 40 denotes a blade, functioning as a flow meter;

numeral 42 denotes a control circuit;

numeral 48 denotes a fan, for producing air flow, for blowing the hair;

numeral 50 denotes an electric motor, for rotating the fan;
numeral 52 denotes a gas tank;
numeral 54 denotes a hinge of lever 16;
numeral 56 denotes a gas faucet, including a gas inlet;
numeral 58 denotes a button;
numeral 60 denotes the end side of the lever;
numeral 62 denotes a rack of the electric motor;
numeral 64 denotes the burner outlet;
numeral 66 denotes an air inlet of the burner;
numeral 68 denotes a drum;
numeral 70 denotes a track fixed to drum 68, for rotating the drum, by the crank moving in the ear;
numeral 72 denotes a crank, for rotating the drum;
numeral 74 denotes a crank, for controlling the burning gas supply level;
numeral 76 denotes a track for moving in a slit, for controlling burning gas faucet 56, for controlling the burning gas supply level;
numeral 78 denotes the slit, in which track 76 is movable;
numeral 100 denotes a gas burner;
numeral 101 denotes a servo motor;
numeral 102 denotes a servo motor, for moving crank 74, for controlling burning gas faucet 56;
numeral 110 denotes an air inlet;
numeral 112 denotes an air outlet;
numeral 114 denotes the main air flow;
numeral 116A denotes a portion of the main air flow, entering the burner, for feeding the flame;
numeral 118 denotes the flame;
numeral 120 denotes an electric wire; and
numeral 122 denotes a thermostat, by which the user tunes the heat supply.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A hot air blower, comprising:

an air channel for blowing a main stream of air therethrough by an electric fan;

a gas tank, for supplying burning gas;

a gas burner, comprising:

a) an air inlet, disposed within said air channel, for receiving a first portion of said main air stream;

b) a burning gas inlet for receiving said burning gas; and c) an outlet , disposed within said air channel, thereby said gas burner produces a flame at said outlet within said air channel, for heating said main air stream, wherein the flame is fed by said first air portion, by said burning gas, and by a second portion of the main stream not entering said gas burner; and a mechanism, for automatically fitting a size of said air inlet to an extent of said main air stream and consequently to an extent of said second portion thereof, thereby maintaining the flame durable to changes of said main stream without requiring changing supply rate of the burning gas.

2. A hot air blower according to claim 1, wherein said mechanism for automatically fitting the size of said air inlet to the extent of said main air stream comprises a hole for changing congruency thereof with said air inlet.

3. A hot air blower according to claim 1, wherein said mechanism, for automatically fitting the size of said air inlet to the extent of said main air stream comprises:

an air flow meter, for measuring the extent of said main air stream.

4. A hot air blower according to claim 1, wherein said mechanism, for automatically fitting the size of said air inlet to the extent of said main air stream comprises:

a servo motor, for decreasing and increasing size of said air inlet; and a control circuit, for controlling said servo motor.

5. A hot air blower according to claim 1, further comprising:

a speed selector, for selecting speed for said fan, thereby allowing changing heat supply level of said hot air blower.

6. A hot air blower according to claim 1, further comprising:

a thermostat, for selecting heat supply level of said hot air blower.

* * * * *